US006341710B1

(12) United States Patent
Danielson et al.

(10) Patent No.: US 6,341,710 B1
(45) Date of Patent: Jan. 29, 2002

(54) SHEATHED RECEPTACLE WITH LOCKING MEANS

(75) Inventors: Charles R. Danielson, Edina; Robert A. Danielson, Eden Prairie, both of MN (US)

(73) Assignee: BCB Innovations, Inc., Edina, MN (US)

( * ) Notice: Subject to any disclaimer, the term of this patent is extended or adjusted under 35 U.S.C. 154(b) by 0 days.

(21) Appl. No.: 09/694,147

(22) Filed: Oct. 23, 2000

(51) Int. Cl.[7] ..... B65D 43/12

(52) U.S. Cl. ..... 220/281; 220/326; 220/345.3; 220/787; 206/38; 206/37

(58) Field of Search ..... 220/345.1, 345.2, 220/345.3, 345.4, 326, 787, 788, 281; 206/38, 38.1, 305, 37.1, 538, 539, 37; 292/19; 24/614, 615, 616, 625, 634; 224/255

(56) References Cited

U.S. PATENT DOCUMENTS

| | | | | | |
|---|---|---|---|---|---|
| 1,104,366 | A | * | 7/1914 | Mahn | |
| 2,353,819 | A | | 7/1944 | Duell | |
| 2,516,907 | A | * | 8/1950 | Penfold | 24/615 |
| 2,708,026 | A | | 5/1955 | Duell | |
| 3,414,119 | A | | 12/1968 | Finch | |
| 3,600,917 | A | * | 8/1971 | Krock | |
| 3,639,950 | A | * | 2/1972 | Lutz | 24/615 |
| 3,888,350 | A | | 6/1975 | Horvath | |
| 4,007,828 | A | * | 2/1977 | Mayled | |
| 4,076,117 | A | * | 2/1978 | Wisdom et al. | 220/345.3 |
| 4,113,098 | A | | 9/1978 | Howard | |
| 4,342,403 | A | | 8/1982 | Badtke et al. | |
| 4,378,885 | A | | 4/1983 | Leopoldi et al. | |
| 4,542,631 | A | | 9/1985 | Esser, III | |
| 4,561,544 | A | | 12/1985 | Reeve | |
| 4,688,337 | A | * | 8/1987 | Dillner et al. | 24/615 |
| 4,765,459 | A | | 8/1988 | Edwards | |
| 4,844,284 | A | | 7/1989 | Drozd et al. | |
| 5,080,222 | A | | 1/1992 | McNary | |
| 5,082,137 | A | | 1/1992 | Weinstein | |
| 5,263,577 | A | * | 11/1993 | Paratte et al. | 206/38.1 |
| 5,318,177 | A | | 6/1994 | Isacson | |
| 5,467,871 | A | | 11/1995 | DeField | |
| 5,480,249 | A | * | 1/1996 | Kageyama et al. | 220/345.3 |
| 6,119,864 | A | * | 9/2000 | Kessler et al. | |

FOREIGN PATENT DOCUMENTS

| | | |
|---|---|---|
| FR | 1394243 | 2/1964 |

* cited by examiner

*Primary Examiner*—Nathan J. Newhouse
(74) *Attorney, Agent, or Firm*—Haugen Law Firm PLLP

(57) ABSTRACT

A sheathed receptacle device for securing objects within an associated enclosure includes an object receptacle having outwardly-extending tabs which engage with respective slots in the enclosure to secure the receptacle within the enclosure. In a particular embodiment, the receptacle includes gripping portions integrally formed with the outwardly-extending tabs in a cantilevered body having a spring action such that manual depression of the gripping portions directly actuates the tabs into and out of respective slots in the associated enclosure.

15 Claims, 6 Drawing Sheets

SHEATHED RECEPTACLE WITH LOCKING MEANS

FIELD OF THE INVENTION

The present invention relates to sheathed receptacles generally, and more particularly to sheathed receptacles having locking means for securing the receptacles within respective enclosures. The present invention also relates to methods for securing receptacles within respective enclosures.

BACKGROUND OF THE INVENTION

A variety of receptacles for use in removable relationship with associated enclosures have been proposed and implemented. In particular, relatively smaller portable sheathed receptacles have become more popular as small totable products have pervaded society. Such small products include compact batteries, vitamins, pharmaceuticals in various forms, keys, and so forth. Some of these products, e.g. certain medications, may need to be accessed in short periods of time, such that immediate availability of such products is desirable. Portable receptacles may be used to store and dispense such products, and thus provide convenient means for keeping such products on-hand at all times.

An important feature of such portable receptacles is to provide a means for securing the receptacles within an associated enclosure, so as to prevent unwanted receptacle removal and, potentially, spillage of the respective products. Furthermore, such securing means preferably inhibits ready access by small children and the like. Thus, an actuating means is desired to enable receptacle removal without allowing unwanted receptacle ejection from associated enclosures.

Portable receptacles proposed and implemented to date have utilized various receptacle securing means for holding the receptacles within respective enclosures. Most applications, however, do not provide an easy and reliable means for securing receptacles within associated enclosures, and for efficiently actuating removal of such receptacles from respective enclosures.

It is therefore a principle object of the present invention to provide a simple and efficient means for securing and actuating removal of a receptacle within an enclosure.

It is a further object of the present invention to provide a portable storing and dispensing receptacle which includes a simple and efficient means for securing and actuating removal of the receptacle within an enclosure.

It is a yet further object of the present invention to provide a portable storage and dispensing device having a releasable locking means for releasably securing a receptacle within an enclosure.

It is a still further object of the present invention to provide unified means for securing and actuating removal of a receptacle within an enclosure.

It is another object of the present invention to provide a means for attaching a portable storage/dispensing device to various objects.

SUMMARY OF THE INVENTION

By means of the present invention, an improved device for storing small objects is provided. Contemplated in the invention is an object receptacle having a base and walls defining bounded areas for holding such objects. The receptacle further includes a handle portion extending from the base, which handle portion has gripping portions extending outwardly from opposing side edges of the handle portion such that the gripping portions are substantially in face-to-face relationship with one another. Securing means extend from, and integrally formed with, the gripping portions.

To secure the objects held in the receptacle bounded areas, the receptacle is inserted into a sheath-like enclosure. At a desired point of insertion into the enclosure, the securing means become aligned with respective slots in the enclosure, and preferably engage with such slots to secure the receptacle in the enclosure. The enclosure is preferably sized and configured to receive the receptacle such that the respective objects are secured between the bounded areas of the receptacle and respective walls of the enclosure.

In a particular embodiment of the sheathed receptacle device, the integrally formed gripping portions/securing means are cantilevered from a wall extending upwardly from a distal edge of the handle portion. Such a cantilevered arrangement provides a spring action to the integral body embodying the gripping portions and the securing means. Through such a spring action on the integral body, the gripping portions may be manually manipulated to directly actuate the securing means into and out of the respective slots in the associated enclosure. Thus, the present invention provides a means for simultaneously gripping an object receptacle and actuating an integral securing means, which allows a user to easily and efficiently insert and remove the object receptacle from the enclosure.

A further aspect of the present invention includes an aperture in the sheathed receptacle device for connection of the device to various objects such as key rings and the like. Such an aperture may be disposed in the enclosure or in the handle portion of the receptacle, or in any position that allows the user to attach the device to another object.

DETAILED DESCRIPTION OF THE PREFERRED EMBODIMENTS

The objects and advantages enumerated above together with other objects, features and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Figure 1:
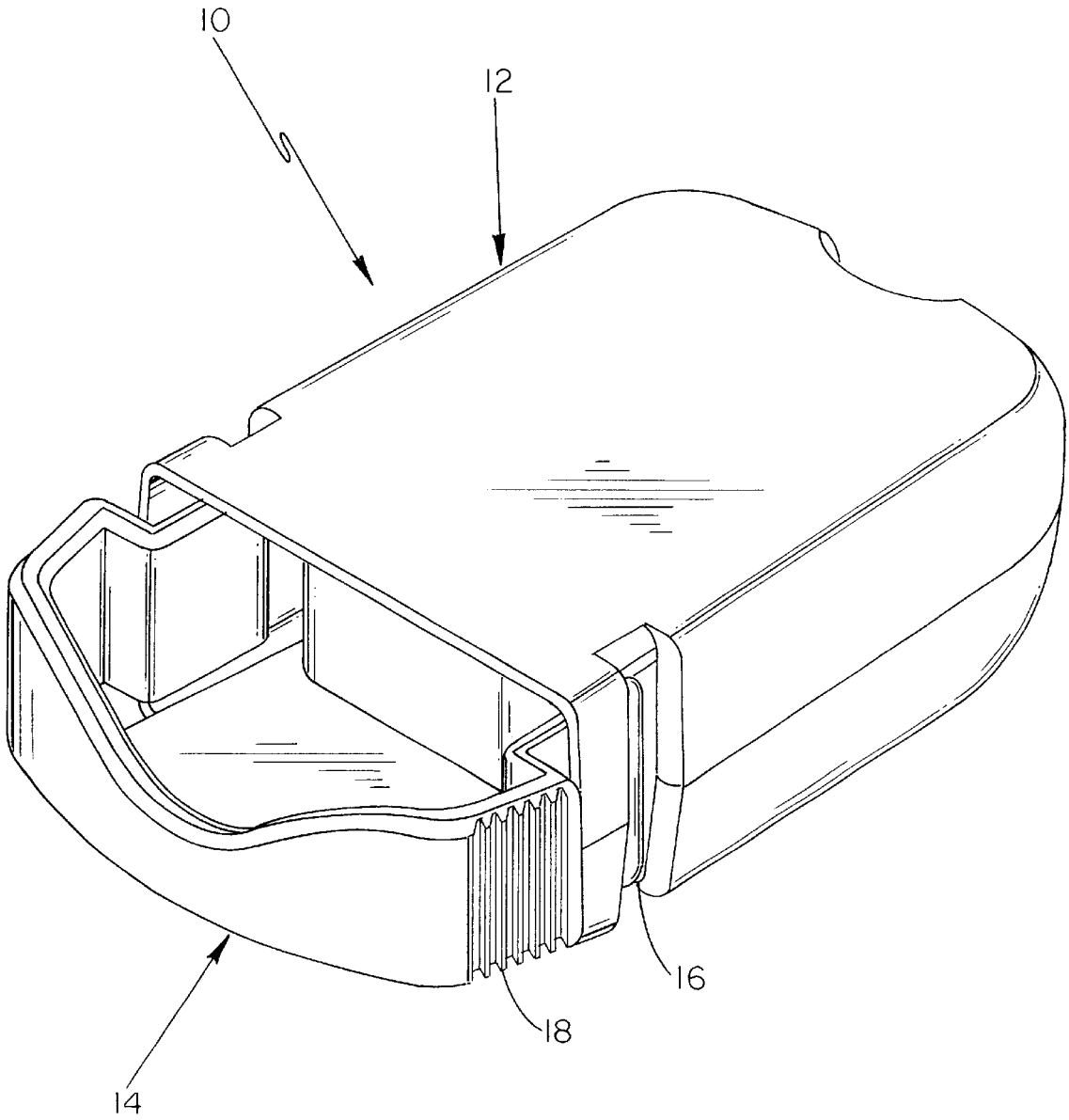
FIG. 1 is an isometric view of a portable container of the present invention.

Referring now by characters of reference to the drawings, and first to FIG. 1, a sheathed receptacle device 10 is shown. Sheathed receptacle device 10 preferably includes an enclosure 12 and a tray-like receptacle 14 inserted therein. In preferred embodiments of the present invention, receptacle 14 is secured within enclosure 12 through securing means, as is designated at 16. The receptacle 14 may then be removed from enclosure 12 by actuating unlocking means, as designated at 18. In preferred embodiments, unlocking means 18 is formed integral with securing means 16.

Figure 2:
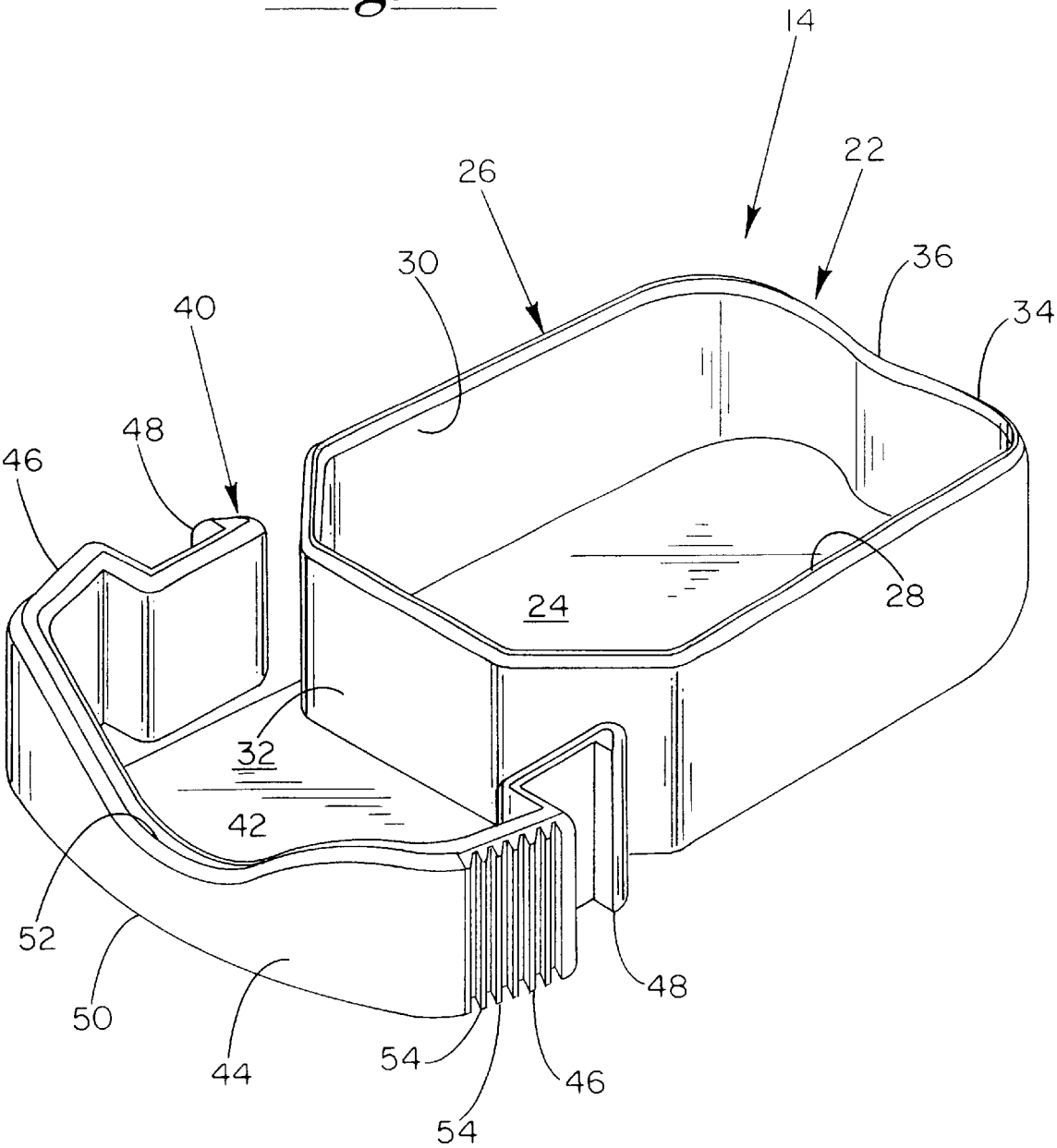
FIG. 2 is an isometric view of the receptacle shown in FIG. 1.

Receptacle 14 is shown in more detail in the isometric view of FIG. 2. In the embodiment shown in FIG. 2, receptacle 14 includes a tray portion 22 having a base 24 and an upstanding wall 26 extending along a perimeter of base 24. Wall 26 may be continuous or discontinuous, and may not be in alignment with an outer perimeter of base 24. In the embodiment illustrated in FIG. 2, wall 26 generally includes first and second generally opposing side sections 28, 30, and first and second generally opposing end sections 32, 34. End section 34 preferably includes a concave portion 36.

The present invention contemplates various configurations for tray portion 22 of receptacle 14. Tray portion 22 may include multiple walled sections of various size, individual walled or enclosed compartments, or any other configuration which may be desirable for particular applications.

Receptacle 14 also includes a handle portion 40 extending generally outwardly from base 24 of tray portion 22. Handle portion 40 preferably includes an extension member 42 and an upstanding wall 44 extending upwardly from at least a portion of extension member 42. In the embodiment shown in FIG. 2, extension member 42 generally extends in a plane coextensive with base 24 of tray portion 22. Preferably, handle wall 44 includes generally opposed gripping portions 46 and generally opposing locking ears 48, wherein respective gripping portions and locking ears are formed integral with one another. In preferred embodiments of the present invention, gripping portions 46 and locking ears 48 are cantilevered from handle wall 44. Such cantilevering provides spring-like action to the gripping portions and locking ears so that a user may impart inward pressure on the gripping portions 46 to deflect the gripping portion/locking ear combinations inwardly, thereby alternatively engaging and disengaging the respective locking ears 48 in enclosure 12.

As shown in the embodiment of FIG. 2, handle wall 44 preferably extends upwardly from a distal end 50 of handle portion 40 such that handle wall 44 is substantially parallel to end portion 32 of tray wall 26. In some embodiments, handle wall 44 includes a depressed portion 52, which depressed portion assists a user in grasping handle portion 40 of receptacle 14.

Gripping portions 46 preferably extend from handle wall 44 in a direction substantially toward tray portion 22, and are disposed in a generally face-to-face relationship with one another such that respective inner surfaces of the gripping portions substantially face each other. Gripping portions 46 preferably include textured surfaces 54. Such textured surfaces may be in the form of ridges and grooves, raised areas, depressed areas, or any other texture pattern which aids a user in grasping the gripping portions 46.

Figure 3:
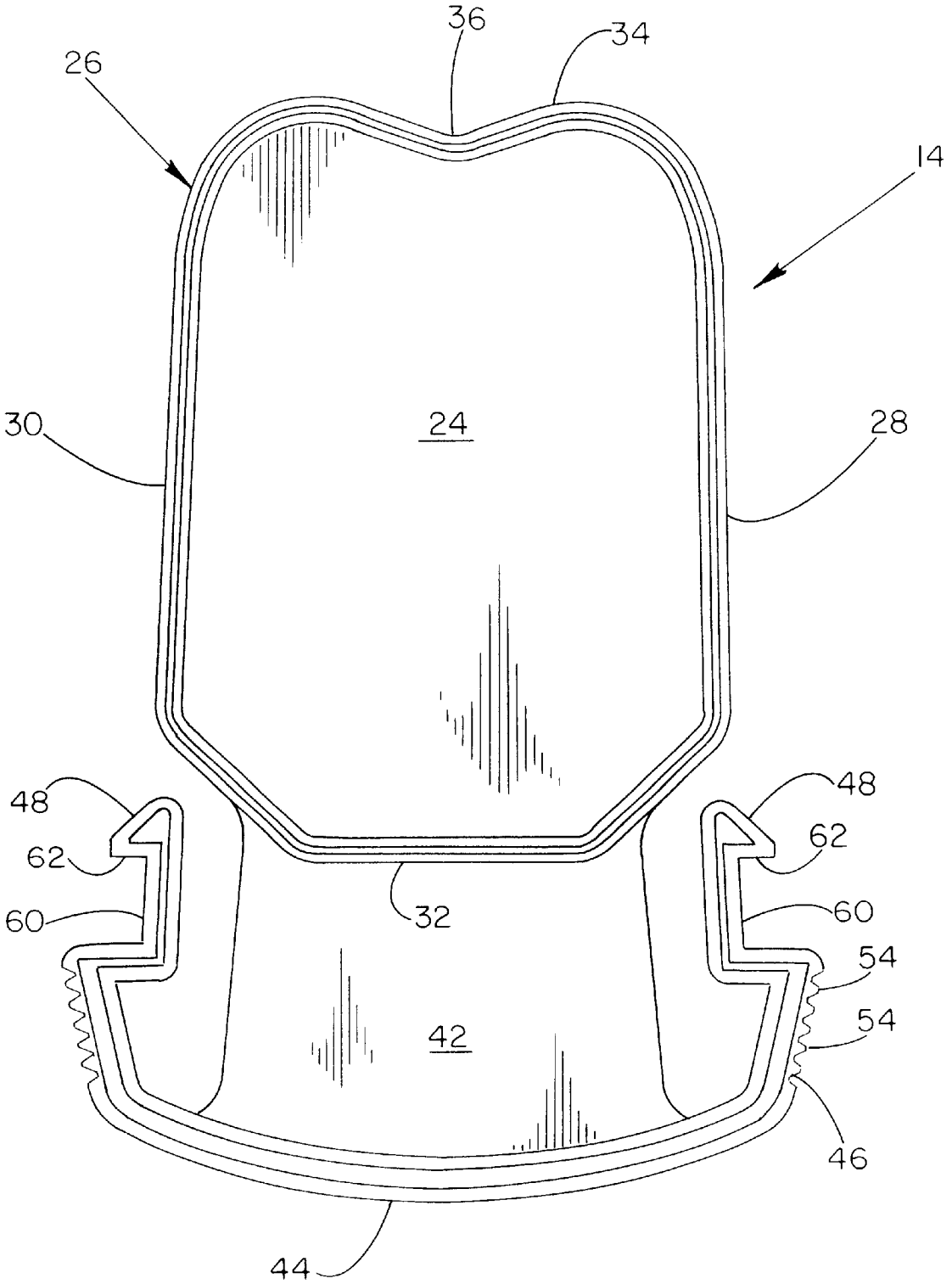
FIG. 3 is a top view of the receptacle shown in FIGS. 1 and 2.

As is better illustrated in FIG. 3, which is a top view of the receptacle 14 of FIG. 2, locking ears 48 preferably comprise knobs or flanges that extend outwardly from locking extension members 60. In a particular embodiment, locking ears 48 include relatively flat portions 62 that face substantially perpendicularly to the respective side sections 28, 30 of tray wall 26. As shown in FIG. 3, locking extension members 60 and locking ears 48, in combination, preferably form a substantially unshaped arrangement, with locking ears 48 being disposed inwardly of gripping portions 46. Such an arrangement, however, is but exemplary of a variety of locking ear/extension member combination arrangements contemplated by the present invention, each of which has the intended purpose of providing a means for integrally securing receptacle 14 within enclosure 12 and alternatively removing the receptacle from the enclosure.

Figure 4:
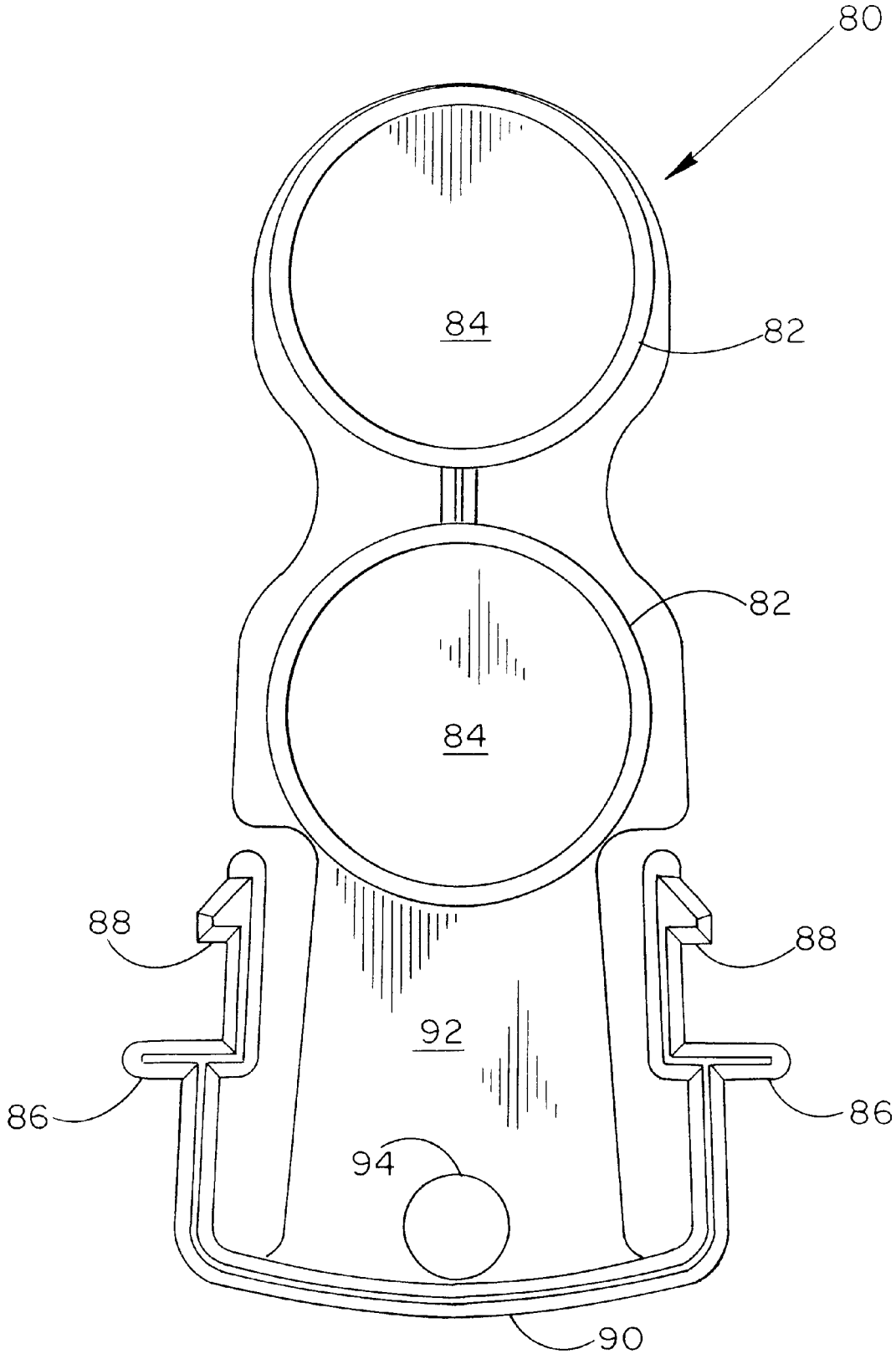
FIG. 4 is an alternative embodiment of a receptacle utilized in the present invention.

FIG. 4 illustrates an alternative embodiment of the receptacle, as designated at 80. Receptacle 80 includes upwardly-extending wall portions 82 which define enclosed areas 84. In preferred embodiments receptacle 80 includes multiple enclosed areas 84, which areas are preferably sized and configured to receive various products, including vitamins, compact batteries, pharmaceuticals, and the like. Such enclosed areas 84 may be sized and configured to receive designated products so that such products may be relatively tightly secured within respective enclosed areas 84.

In the embodiment shown in FIG. 4, gripping portions 86 and locking ears 88 are cantilevered from handle wall 90. Gripping portions 86 may include outwardly-extending tabs which provide a means for depressing the gripping portions inwardly, to thereby actuate the locking ears 88. Handle portion 92 may include an aperture 94 for connection purposes to various objects such as key rings and the like.

Figure 5:
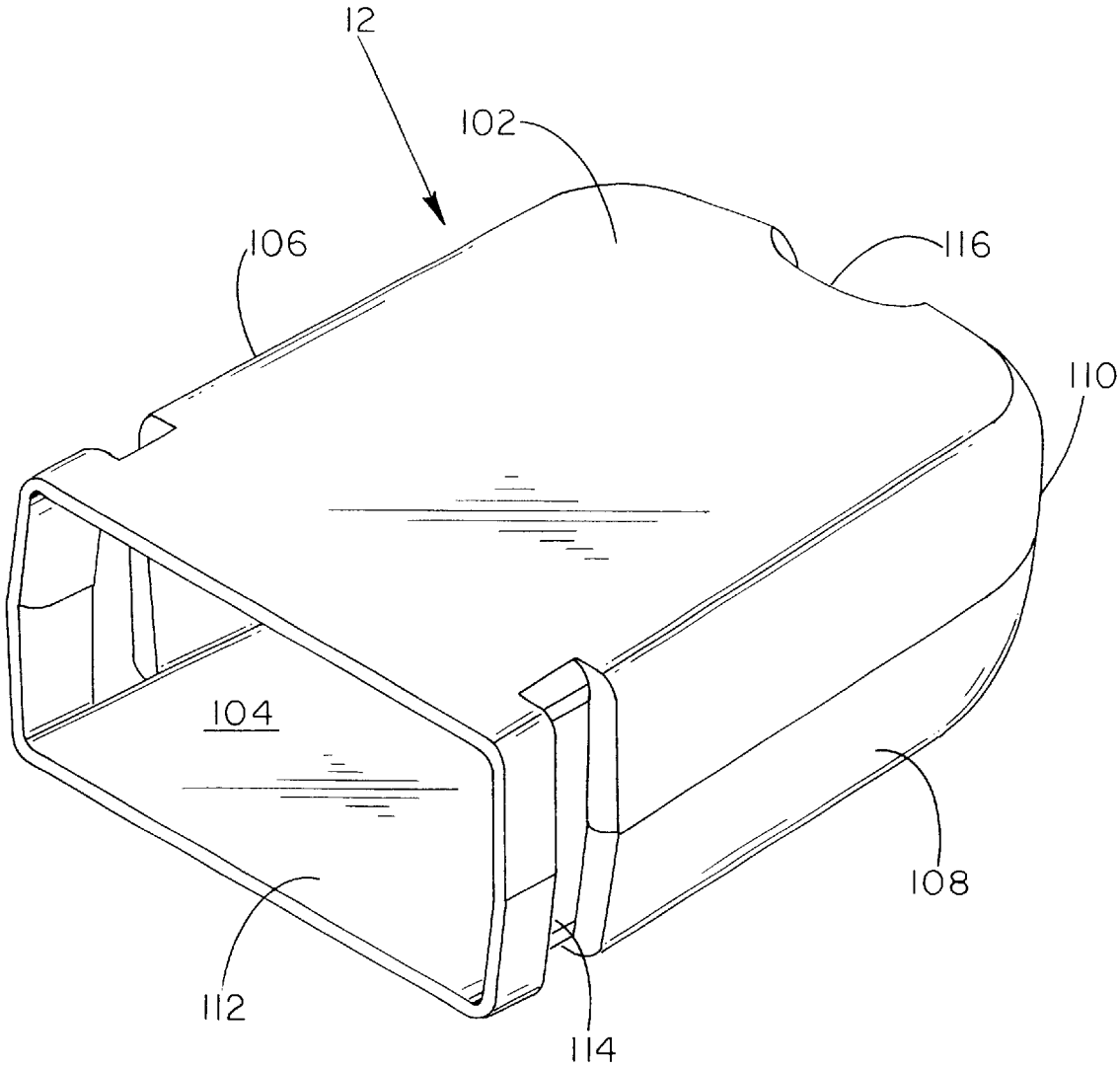
FIG. 5 is an isometric view of the enclosure shown in FIG. 1.

The enclosure 12 of FIG. 1 is shown in greater detail in the isometric view of FIG. 5. Sheath-like enclosure 12 preferably includes a top 102, a generally opposing bottom 104, a first side 106 and a generally opposing second side 108, and a closed end 110 and a generally opposing open end 112. In a preferred embodiment of the present invention, enclosure 12 includes one or more slots 114 formed in respective sides 106, 108. In some embodiments, slots 114 may extend through respective sides 106, 108. In other embodiments, however, slots 114 may not extend entirely through respective sides 106, 108, or may be formed in other locations of enclosure 12. Enclosure 12 preferably includes an open passageway 116 extending therethrough for connection purposes to various objects such as key rings and the like.

Open end 112 of enclosure 12 is preferably sized and configured to receive receptacle 14 such that locking ears 48 may be engaged with slots 114. In preferred embodiments of the present invention, a portion of receptacle 14 protrudes outwardly from open end 112 when receptacle 14 is fully inserted into enclosure 12.

Figure 6:
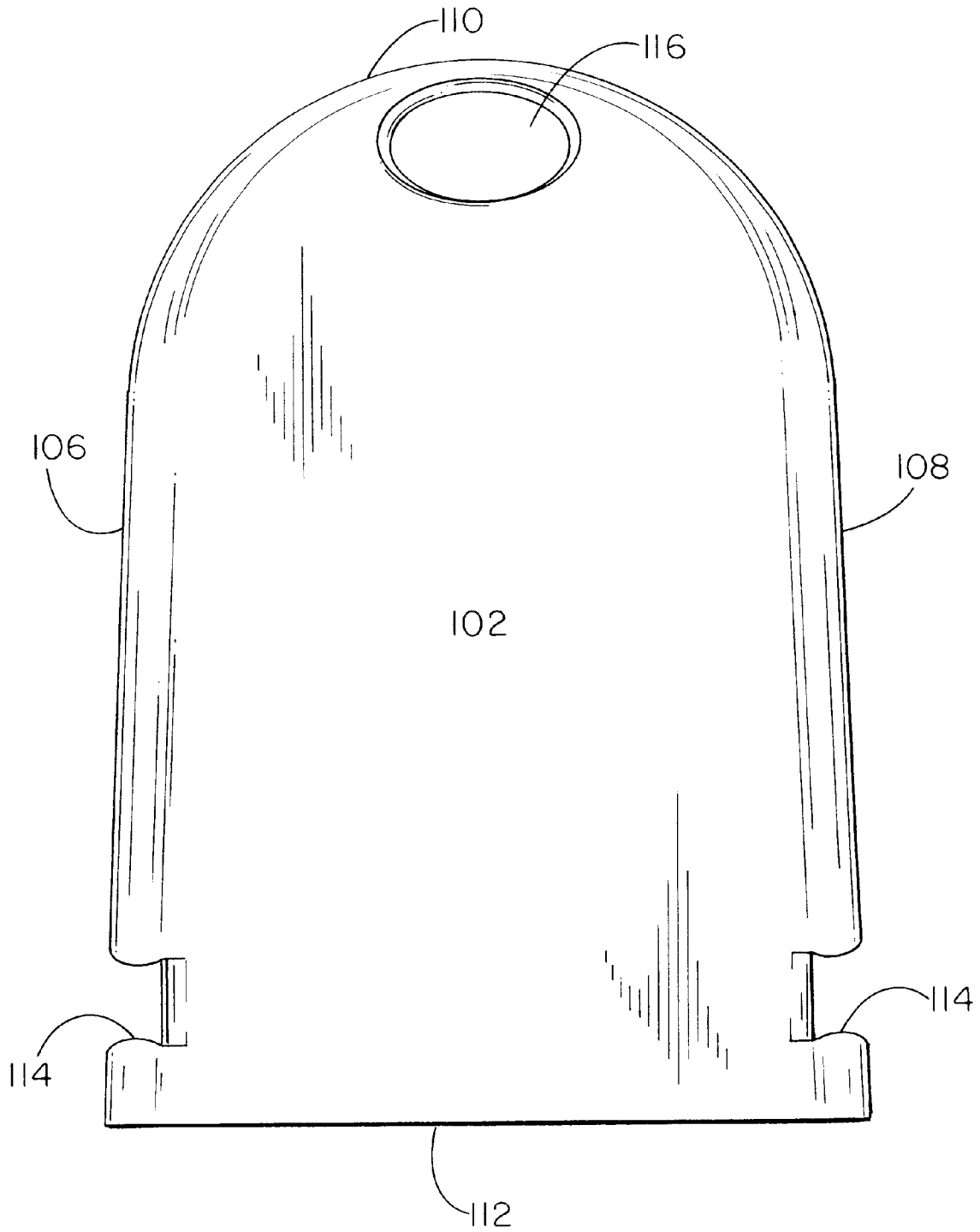
FIG. 6 is a top view of the enclosure shown in FIGS. 1 and 5.

A top view of the enclosure 12 of FIG. 5 is shown in FIG. 6. Slots 114 may extend through a portion of enclosure top 102 and/or enclosure bottom 104. Furthermore, slots 114 may be positioned at any location along respective sides 106, 108, so long as locking means 16 may be received therein. As can be seen more clearly in FIG. 6, closed end 110 may be curved for appearance or functionality purposes.

Receptacle 12 and enclosure 14 are preferably fabricated from durable materials, particularly those which may be molded into various arrangements. The cantilevered gripping portions, extension portions, and locking ears preferably have a degree of elasticity, such that the cantilevered portions provide a spring action when depressed inwardly. Preferred materials include various plastics. Individual components making up the present invention are preferably formed in an injection molding process utilizing thermoplastic materials. Other common fabrication methods such as stamping or vacuum molding are also contemplated in the present invention.

In preferred embodiments of the present invention, small products placed in receptacle 14 may be stored within enclosure 12 when the receptacle is inserted into the enclosure. Enclosure 12 is preferably sized and configured to receive at least a portion of receptacle 14. Most preferably, tray portion 22, securing means 16, and a portion of handle portion 42 may be received in enclosure 12. In some embodiments, an upper edge 27 of wall 26 is adjacent to, or in intimate contact with, top 102 of enclosure 12 when receptacle 14 is inserted into enclosure 12, such that most products positioned in containment areas in receptacle 14 may not escape. Such positioning of wall 26 adjacent to, or in intimate contact with, top 102 of enclosure 12 may provide a degree of moisture resistance for products held within the containment areas, in that moisture is inhibited from passing between wall 26 and top 102 to enter the containment areas. The moisture resistance characteristic may be advantageous in storing pharmaceuticals which are moisture-sensitive. To maximize area within the containment areas, a portion of wall 26 may be adjacent or in intimate contact with respective sides 106, 108 of enclosure 12.

Sheathed receptacle 10 is preferably operated by initially placing objects to be stored in respective containment areas of receptacle 14. The loaded receptacle is then inserted into open end 112 of enclosure 12 until locking ears 48 abut respective sides 106, 108 of enclosure 12 at open end 112. A user then depresses unlocking means 18 by inwardly squeezing gripping portions 46, which actuates securing means 16 inwardly. The user subsequently continues to insert receptacle 14 into enclosure 12 while depressing unlocking means 16 until locking ears 48 are in alignment with slots 114 in enclosure 12. To secure receptacle 14 within enclosure 12, the user releases the inward pressure on gripping portions 46, and allows locking ears 48 to engage with slots 114. To remove receptacle 14 from enclosure 12, the user depresses unlocking means 18 at gripping portions 46 to actuate securing means inwardly, thereby removing locking ears 48 from slots 114. With the securing means actuated inwardly, the user may remove receptacle 14 from enclosure 12.

A particular feature of the present invention is embodied in the integral and cantilevered nature of the unlocking means 18 and the securing means 16. Such an arrangement allows a user to simultaneously obtain a firm grip on receptacle 14 while actuating securing means 16. Thus, inward pressure of unlocking means 18 at gripping portions 46 provides a convenient gripping means and an actuating means simultaneously. The cantilevered arrangement provides sufficient spring action in the unlocking means to enable effective actuation of the securing means in and out of respective slots 114.

The invention has been described herein in considerable detail in order to comply with the Patent Statutes, and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. A portable container, comprising:

(a) a receptacle having a base and walls extending upwardly therefrom, thereby defining one or more bounded areas on said receptacle;

(b) a handle portion extending outwardly from such bounded areas in a plane generally parallel to said base;

(c) gripping portions extending upwardly and outwardly from said handle portion, at least a portion of said gripping portions being disposed on opposing edges of said handle portion such that the gripping portions are generally in face-to-face relationship with one another;

(d) locking tabs extending from said gripping portions in a direction generally parallel to said base and generally toward such bounded areas, said locking tabs including securing ears extending from respective distal edges of said locking tabs in a generally outward direction such that said securing ears extend generally away from one another; and (e) a sheath-like enclosure having an open end being sized and configured to receive said receptacle, said enclosure including a bottom, a generally opposing top, and first and second generally opposing sides interposed between said top and bottom along perimeters of the respective said top and bottom, said first and second sides having respective slots formed therein, the slots extending generally perpendicular to said enclosure top and bottom, and are sized and configured to receive said securing ears of said receptacle when said receptacle is inserted into said enclosure.

2. A portable container as in claim 1 wherein said receptacle walls extend upwardly along an outer perimeter of said base.

3. A portable container as in claim 1 wherein said handle portion is an extension of said base.

4. A portable container as in claim 1 wherein said locking tabs are substantially u-shaped, including respective first leg portions extending inwardly toward one another, respective second leg portions extending generally in parallel to one another in a direction toward such enclosed areas, and respective third leg portions extending generally outwardly away from one another.

5. A portable container as in claim 1 wherein said base walls extend to a height such that when said receptacle is inserted into said enclosure, respective distal edges of said base walls are propinquant to the top of said enclosure.

6. A portable container as in claim 1, including an aperture in said enclosure for use in attaching the container to various objects.

7. A portable container as in claim 1 wherein said locking tabs and said securing ears are formed integral with said gripping portions such that pressure on said gripping portions actuates said locking tabs and said securing ears.

8. A portable container as in claim 1, including an end wall extending upwardly from said handle portion, said end wall connecting said oppositely disposed gripping portions.

9. A portable container as in claim 8 wherein said gripping portions and said locking tabs are cantilevered from said end wall such that pressure on said gripping portions provide a spring action.

10. A portable container as in claim 9 wherein said locking tabs and said securing ears are formed integral with said gripping portions such that pressure on said gripping portions actuates said locking tabs and said securing ears.

11. A portable container as in claim 9 wherein said locking tabs are substantially u-shaped, including respective first leg portions extending inwardly toward one another, respective second leg portions extending generally in parallel to one another in a direction toward such enclosed areas, and respective third leg portions extending generally outwardly away from one another.

12. A portable container as in claim 11 wherein said respective first leg portions are relatively longer than said respective third leg portions.

13. A method for securing objects within an enclosure, comprising:

(a) providing a receptacle having a base and walls extending upwardly therefrom, thereby defining one or more bounded areas on said receptacle, said receptacle including a handle portion extending outwardly from such bounded areas, said handle portion including gripping portions cantilevered therefrom, said gripping portions extending from opposing side edges of said handle portion, said gripping portions including locking tabs extending therefrom in a direction generally toward such bounded areas, said locking tabs including securing ears extending outwardly therefrom, and a sheath-like enclosure having an open end being sized and configured to receive said receptacle, said enclosure having one or more slots formed therein, which slots are sized and configured to receive said securing ears when said receptacle is inserted into said enclosure;

(b) positioning the objects within such bounded areas on said receptacle; and (c) inserting said receptacle into said enclosure through the open end of said enclosure until said securing ears engage with the slots in said enclosure.

14. A method as in claim 13 wherein said securing ears and said gripping portions are integrally formed and cantilevered from said handle portion of said receptacle.

15. A method as in claim 14 wherein said securing ears may be directly actuated into and out of the slots in said enclosure by depressing said gripping portions.

* * * * *